United States Patent [19]

Dixon et al.

[11] Patent Number: 4,677,338

[45] Date of Patent: Jun. 30, 1987

[54] ELECTRIC LAMPS HAVING OUTER STEM SURFACE WHICH MINIMIZES INTERNAL REFLECTIONS

[75] Inventors: Angus B. Dixon, Greater Manchester; Alan Prest, Rochdale; Paul Thorpe, Oldham, all of England

[73] Assignee: The General Electric Company, p.l.c., England

[21] Appl. No.: 787,448

[22] Filed: Oct. 15, 1985

Related U.S. Application Data

[63] Continuation-in-part of Ser. No. 470,216, Feb. 28, 1983, abandoned.

[30] Foreign Application Priority Data

May 7, 1982 [GB] United Kingdom ..... 8213302

[51] Int. Cl.[4] ..... H01J 5/38; H01J 61/52; H01J 61/36

[52] U.S. Cl. ..... 313/43; 313/116; 313/623; 313/634

[58] Field of Search ..... 313/43, 44, 116, 331, 313/332, 634, 623, 626; 174/50.61, 50.58

[56] References Cited

U.S. PATENT DOCUMENTS

| | | | |
|---|---|---|---|
| 1,599,241 | 9/1926 | Mery | 313/44 X |
| 1,846,741 | 2/1932 | Linse | 313/116 |
| 2,706,262 | 4/1955 | Barnes | 313/116 X |
| 3,080,497 | 3/1963 | Noel et al. | 313/43 |
| 3,515,929 | 6/1970 | Kearney et al. | 313/634 X |
| 3,991,337 | 11/1976 | Notelteirs | 313/332 X |

*Primary Examiner*—Palmer C. DeMeo
*Assistant Examiner*—Sandra L. O'Shea
*Attorney, Agent, or Firm*—Kirschstein, Kirschstein, Ottinger & Israel

[57] ABSTRACT

In a lamp having at least one seal of solid light-transmitting material, in which is embedded at least one current-supply foil, visible, I.R. and U.V. radiations which would otherwise be internally reflected from the seal surface are dispersed by providing on the seal either a non-uniform surface region or a light-dispersive coating, thus reducing the temperature of the outer ends of the foil and thereby reducing the risk of failure caused by oxidation. The seal may be formed with ribs or sand blasted or it may be provided with a coating of glass containing reflective particles or gas bubbles.

17 Claims, 4 Drawing Figures

ELECTRIC LAMPS HAVING OUTER STEM SURFACE WHICH MINIMIZES INTERNAL REFLECTIONS

CROSS-REFERENCE TO RELATED APPLICATION

This application is a continuation-in-part of co-pending patent application Ser. No. 470,216 filed Feb. 28th 1983 now abandoned.

BACKGROUND OF THE INVENTION

The present invention relates to electric discharge and incandescent lamps of the type comprising a light-transmitting envelope having contained therein a source of light such as a filament or a pair of electrodes between which an electric discharge is produced, such that on energisation of the lamp there will be emitted visible light, I.R. and U.V. radiation, and incorporating at least one seal of solid light-transmitting material in which is embedded at least one current-supply foil running substantially the length of the seal, the current-supply foil being connected at one end to a conducting support for a filament or for an electrode within the envelope, and at the other end to a current-supply pin. The invention is particularly appplicable to high power (e.g. 2.5 kW) electric discharge lamps such as the MEI lamp, which are used for television and film lighting. Such lamps comprise a silica envelope integral with either one or two silica supporting stems providing one or two said seals and are referred to as single and double-ended lamps respectively, the current-supply foils being generally of molybdenum. The protruding end of each current supply pin is usually connected to a metal lamp cap which encloses the outer end of the seal.

The adjacent ends of the filament or electrode supports and the current-supply pins are also embedded in the material of the seal, but as the current-supply pins do not form a completely air-tight seal with the surrounding silica, the welded ends of the foils are liable to oxidise and eventually break if they become hotter than about 250° C. In fact, tests have shown that in a 2.5 kW MEI discharge lamp provided with cylindrical seals 110 mm long and 15 mm in diameter burning in a luminaire in still air, the temperature of the current-supply pins can reach 370° C. if conventional lamp caps are used. Even when the capped lamp is run in a lampholder fitted with cooling fins the temperature of the pins can reach 320° C. Thus even when relatively long seals are provided, the outer ends of the foils can become sufficiently hot for oxidation to occur.

Attempts have been made to reduce the amount of heat reaching the outer ends of the foils by locating a flat collar around the outer end of the or each stem of a lamp envelope embodying a foil seal between the or each welded end of the foil and the lamp envelope, as described in our U.S. patent application Ser. No. 456,273 filed Jan. 6, 1983, now abandoned, and co-pending U.S. patent application Ser. No. 804,096 filed Dec. 3, 1985. The collar acts as an external heat shield, shielding the end of the foil from heat and light radiated from the lamp envelope. A heat sink is commonly fitted to the lamp cap or current-supply pin to increase the heat dissipation from the seal. Even when such precautions are taken, it has been found necessary in some cases to make the stems much longer than is necessary to obtain effective seals. It has been found that this is largely due to heat and light emanating from the source of light in the lamp envelope reflected and transmitted internally through the solid material of the seals towards the outer end of the foils. A considerable proportion of this heat and light which reaches the outer ends of the foils is internally reflected from the surfaces of the seals, which thereby acts as "light pipes". The present invention provides a particularly simple method of reducing the "light pipe" effect in lamps of the type specified.

SUMMARY OF THE INVENTION

According to the present invention, an electric lamp comprises a light-transmitting envelope having contained therein a source of light such as a filament or discharge-producing electrodes, such that on engergisation of the lamp there will be emitted visible light, I.R. and U.V. radiation, and incorporating at least one seal of solid light-transmitting material in which is embedded at least one current-supply foil running substantially the length of the seal, the current-supply foil being connected at one end to a conducting support for a filament or for an electrode within the envelope, and at the outer end to a current-supply pin, the outer end of said current-supply foil being liable to oxidize if heated excessively, as it would be if subjected to said radiation emanating from the filament or the discharge and transmitted internally within the material of the seal, wherein the improvement comprises the seal having a radiation-dispersive external surface region effective to reduce internal reflections within the solid material of the seal of radiations emanating from the lamp and thereby reducing the risk of failure of the outer end of the foil caused by oxidation.

The said surface region may incorporate an optically non-uniform outer layer, which may consist of a layer of scattering centres partially or fully embedded in a low melting point infra-red transparent glass layer which in turn is fused to the surface of the seal. Said scattering centres may be reflective particles of glass, metal, mica, ceramic material or metal, or may be gas bubbles trapped in said glass layer.

In addition or as an alternative to the purely optical methods of producing a dispersive surface region outlined above, a radiation-dispersive surface region may be produced by forming a non-uniform surface profile on the seal. The said non-uniformity may be on a microscopic or macroscopic scale. Thus the surface may be etched or sandblasted to produce a microscopically non-uniform surface profile or the seal may be formed with circumferential grooves and/or ribs during manufacture. The surface may be dimpled and/or the stem as a whole may be formed with one or more bends. It will be appreciated that virtually any substantial distortion of the local surface orientation will randomise the angles of incidence of the light and heat propagated internally along the material of the seal. Provided that a significant proportion of these angles are smaller than the critical angle of the seal material, the radiation propagating along the seal will become progressively attenuated. However we have found that the most advantageous embodiment of the invention from a commercial point of view is produced by sand blasting the surface of the seal along part of its length (say 30 mm) adjacent the lamp envelope.

BRIEF DESCRIPTION OF THE DRAWINGS

The invention will now be described in more detail by reference to the accompanying schematic drawings, of which.

DETAILED DESCRIPTION OF THE PREFERRED EMBODIMENTS

Figure 1:
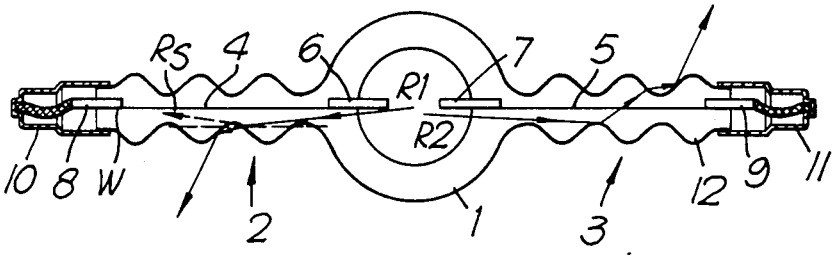
FIG. 1 is an axial section of a double-ended discharge lamp in accordance with the invention.

Referring to FIG. 1, the lamp shown comprises a transparent silica envelope 1 integral with two sopporting stems 2 and 3 constituting seals in which are embedded respective molybdenum current-supply foils 4 and 5. The foils are welded at their inner ends to respective electrodes 6 and 7 and at their outer ends to respective current-supply pins 8 and 9 adjacent ends of the electrodes and supply-pins also being partially embedded in the material of the seal. Pins 8 and 9 are in turn connected to metal lamp caps 10 and 11. The surface of each seal is formed into a series of adjacent circumferential ribs 12, which series constitutes a radiation-dispersive surface region, as illustrated by the typical rays R1 and R2, both of which escape from the stems. The rays RS (shown dashed) is the continuation of R1 which would occur if the surface profile of the seal 2 was smoothly cylindrical. In such a case RS would be internally reflected into the vulnerable weld W connecting the weld W and the pin 8. It will be apparent that the profile of the ridges 12 is not critical, and that the radial cross section of the seals 2 and 3 may be of any convenient shape.

Figure 2:
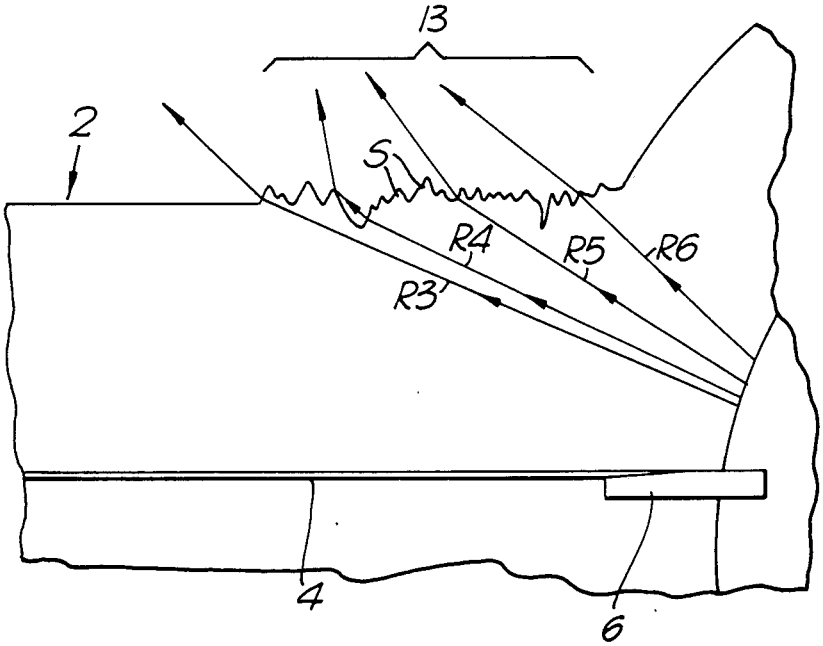
FIG. 2 is an axial section partially cut away of another discharge lamp in accordance with the invention.

FIG. 2 (which illustrates the preferred embodiment of the invention) shows part of a seal 2 of a discharge lamp and a lamp electrode 6 welded to a current-supply foil 4. The surface of the seal 2 is roughended (by etching or preferably by sand blasting, for example) along part of its length as shown at 13, adjacent the lamp envelope. The roughened part 13 of the surface provides a multiplicity of local surfaces S, many of which are nearly perpendicular to rays R3 to R6 from the lamp envelope transmitted internally along the seal. As a result, most of such rays impinging on this surface of the seal escape, so that only a small portion of the heat and light from the envelope propagates along the seal towards the end of the foil 4.

Figure 3:
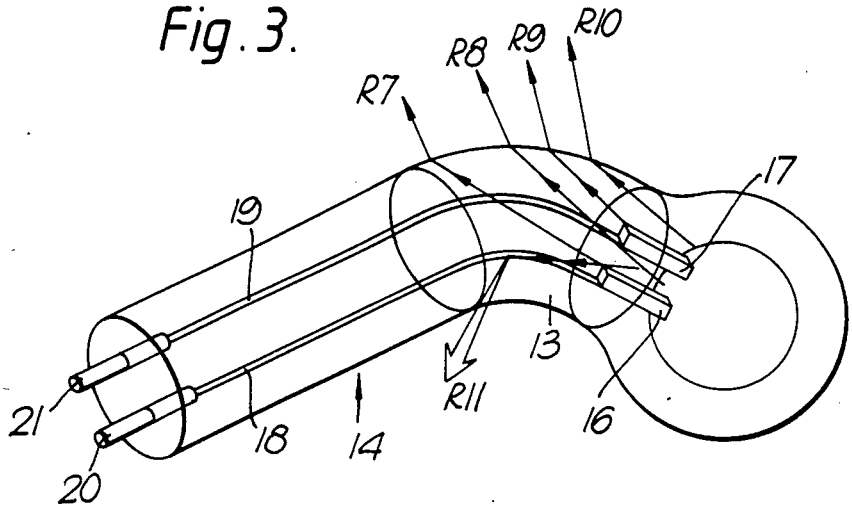
FIG. 3 is a sketch perspective view of a single-ended discharge lamp in accordance with the invention.

FIG. 3 shows a single-ended discharge lamp provided with a bent seal 14. As in the embodiments described above, current is supplied to the lamp electrodes 16 and 17 by respective metal foils 18 and 19 welded to current-supply pins 20 and 21. A region 13 of the surface of the curved part of the seal 14 is roughened. Since most (R7 to R10) of the rays R7 to R11 from the lamp envelope strike the outside of the bend in the seal, even slight inclinations of the local surfaces with respect to the mean surface will suffice to ensure that most local surfaces (not shown) struck by the rays will lie approximately perpendicular to them. As a result, most of the radiation entering the seal from the envelope escapes through the outside part of the bend.

Figure 4:
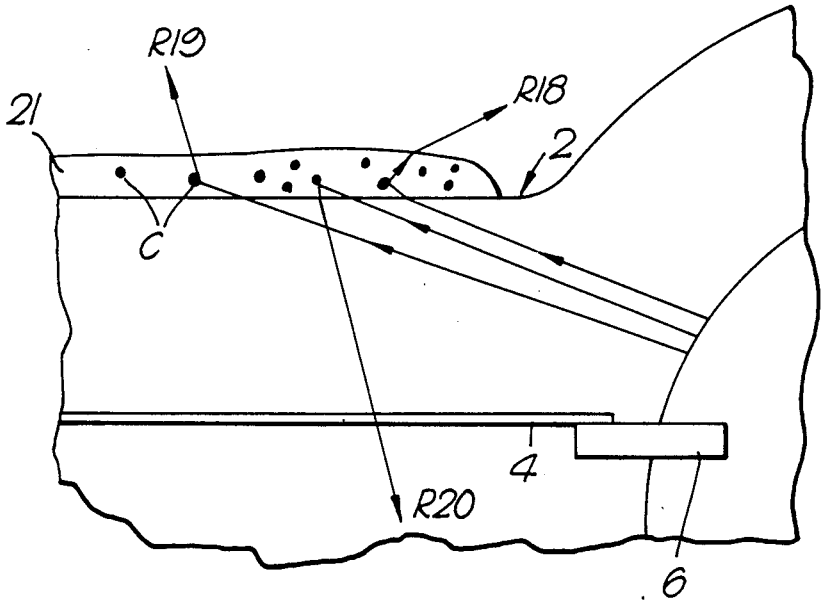
FIG. 4 is an axial cross-section, partially cut away of another single-ended discharge lamp in accordance with the invention.

FIG. 4 shows a lamp provided with a glassy layer 21 on the surface of the seal 2. Preferably the refractive index of the layer 21 is not significantly lower than that of the seal 2. Scattering centres C, which may be gas bubbles, discrete glass particles differing in refractive index from the glassy layer 21, or reflective mica, ceramic or metal particles scatter rays R18 to R20 randomly as shown. Such random scattering progressively attenuates radiation propagating along seal 2. The glassy layer 21 and scattering centres C may be applied to the seal surface 2 by forming a mixture of a suitable first glass frit and either a metal carbonate (if gas bubbles are intended to constitute the scattering centres) or a second glass frit of higher melting point than said first frit (if discrete glass particles are intended to constitute the scattering centres) or otherwise the reflective particles themselves, with a decomposable binder such as polyacrylic acid. The mixture can then be sprayed onto the surface of the seal. The coated seal can then be heated to decompose or evaporate the binder, fuse the said first frit to the seal to form a glassy layer, and, if a metal carbonate is incorporated in the mixture, to decompose this carbonate to form carbon dioxide gas bubbles.

We claim:

1. An oxidation-resistant, high-power electric lamp operable in air, comprising:

a light-transmitting envelope having a bulb, and at least one elongated stem which extends longitudinally from the bulb, and which has an outer stem surface;

means within the bulb for generating and emitting light radiation with concomitant heat radiation, a portion of the light and heat radiation being internally propagated longitudinally within, and along, the stem and constituting internally propagated radiation;

an elongated conductive strip embedded in, and extending longitudinally along, the stem, said strip having a terminal end region remote from the bulb and oxidizable in air at elevated temperatures; and means for resisting oxidation of said oxidizable terminal end region during lamp operation, including means for minimizing internal reflection of the internally propagated radiation off the outer stem surface in a direction into the stem, and for outwardly dispersing the internally propagated radiation transversely of the stem prior to reaching said oxidizable terminal end region to resist oxidation of the same and resist premature lamp failure.

2. The lamp as recited in claim 1, wherein the oxidation-resisting means constitutes a radiation-dispersive region at the outer stem surface at a location between the bulb and said oxidizable terminal end region.

3. The lamp as recited in claim 2, wherein the radiation-dispersive region constitutes a rigid outer stem surface composed fo a plurality of ribs spaced longitudinally along the stem, each rib extending circumferentially around the stem.

4. The lamp as recited in claim 2, wherein the radiation-dispersive region constitutes a roughended outer stem surface.

5. The lamp as recited in claim 2, wherein the radiation-dispersive region constitutes a sand-blasted outer stem surface.

6. The lamp as recited in claim 2, wherein the radiation-dispersive region constitutes a non-uniform outer stem surface.

7. The lamp as recited in claim 6, wherein the non-uniform outer stem surface is non-uniform on a microscopic scale.

8. The lamp as recited in claim 6, wherein the non-uniform outer stem surface is non-uniform on a macroscopic scale.

9. The lamp as recited in claim 2, wherein the radiation-dispersive region constitutes a light-transmitting coating extending circumferentially around the stem, and a multitude of scattering means held by the coating.

10. The lamp as recited in claim 9, wherein the scattering means are embedded in the coating.

11. The lamp as recited in claim 9, wherein the scattering means are gas bubbles.

12. The lamp as recited in claim 9, wherein the scattering means are light-reflecting particles.

13. The lamp as recited in claim 9, wherein the scattering means are glass particles having a refractive index different from that of the coating.

14. The lamp as recited in claim 2, wherein the stem has a bend, and wherein the radiation-dispersive region is located at the bend.

15. The lamp as recited in claim 1, wherein the stem has an end portion; and further comprising an electrical curent-supply pin having an inner end extending into the end portion of the stem and into current-carrying contact with said oxidizable terminal end region of the strip, and an outer end extending outwardly past the end portion of the stem; and also comprising a lamp cap mounted on the end portion of the stem and enclosing the outer end of the current-supply pin.

16. The lamp as recited in claim 15, wherein the envelope has another stem identical to said first-mentioned stem, another current-supply pin identical to said first-mentioned pin, and another lamp cap identical to said first-mentioned lamp cap; and wherein the stems and pins extend longitudinally in opposite directions outwardly from the bulb.

17. The lamp as recited in claim 1, wherein the strip is composed of molybdum.

* * * * *